US005907305A

United States Patent [19]

Epp et al.

[11] Patent Number: 5,907,305

[45] Date of Patent: May 25, 1999

[54] DUAL POLARIZED, HEAT SPREADING RECTENNA

[75] Inventors: Larry W. Epp, Pasadena; Abdur R. Khan, Sierra Madre; R. Peter Smith, La Crescenta; Hugh K. Smith, Pasadena, all of Calif.

[73] Assignee: California Institute of Technology, Pasadena, Calif.

[21] Appl. No.: 08/977,004

[22] Filed: Nov. 24, 1997

Related U.S. Application Data

[63] Continuation of application No. 08/498,481, Jul. 5, 1995, abandoned.

[51] Int. Cl.[6] ..... H01Q 1/38

[52] U.S. Cl. ..... 343/700 MS; 343/701; 343/767

[58] Field of Search ..... 343/700 MS, 701, 343/846, 705, 767, 770, DIG. 2; H01Q 1/38, 13/08, 1/28

[56] References Cited

U.S. PATENT DOCUMENTS

| | | | |
|---|---|---|---|
| 4,847,625 | 7/1989 | Dietrich et al. | 343/700 MS |
| 4,899,164 | 2/1990 | McGrath | 343/700 MS |
| 5,043,738 | 8/1991 | Shapiro et al. | 343/700 MS |
| 5,068,669 | 11/1991 | Koert et al. | 343/700 MS |

*Primary Examiner*—Hoanganh T. Le
*Attorney, Agent, or Firm*—Fish & Richardson P.C.

[57] ABSTRACT

An aperture coupled patch splits energy from two different polarization components to different locations to spread heat. In addition, there is no physical electrical connection between the slot, patch and circuitry. The circuitry is located under a ground plane which shields against harmonic radiation back to the RF source.

29 Claims, 3 Drawing Sheets

DUAL POLARIZED, HEAT SPREADING RECTENNA

This is a continuation of application Ser. No. 08/498,481 filed Jul. 5, 1995, now abandoned.

Origin of Invention

The invention described herein was made in the performance of work under a NASA contract, and is subject to the provisions of Public Law 96-517 (35 USC §202), in which the contractor has elected to retain title.

FIELD OF THE INVENTION

The present invention defines an improved rectifying antenna (a "rectenna"). More specifically, the present invention defines a rectenna intended for receiving dual polarizations in new ways which provides improved power handling performance and heat handling capabilities.

BACKGROUND AND SUMMARY OF THE INVENTION

There are many applications in which it is useful to beam energy from an energy production location to a destination at which the energy will be used. The "beamed" energy is typically microwave, or more generally energy in some radio frequency, or RF band. However, many applications for the energy require dc power. The dc power is sometimes re-converted to AC.

The conversion from microwave to dc has been done in the prior art by using a rectifying antenna, often called a rectenna. Such rectennas can take many different forms. All of these forms must convert the microwave beam into usable dc power with high efficiency. One preferred way forms a number of small rectenna units each with its own rectifying circuitry. The microwave-beamed energy is received over this area.

One particular application of this structure is in an electrically-operated aircraft which circles over a point on the ground, or navigates in the vicinity of a point on the ground. Such a microwave powered aircraft could remain in the air for many months. An appropriate converter between the microwave beam and dc power would receive the microwave beam, convert it to dc, and use that dc both to power the avionics and to power the payload. See, for example, U.S. Pat. No. 4,542,316 to Hart.

The inventors of the present invention have devised a new way to tackle both of these problems. It is an object of the present invention to provide an aperture-coupled patch element which spreads the heat dissipation to avoid heat build up and heat stress.

According to one aspect of the invention, different polarizations of microwave energy are coupled to different parts of the circuit which are physically separated from one another. Since different parts of the circuit handle different parts of the total energy load, this has the effect of spreading the power and heat dissipation among these different parts. The thermal load is hence spread to different locations on the substrate. This avoids heat build up in any one location since the production of heat is more spread out.

Another aspect of the invention relates to the efficiency of RF capture. The conversion of the RF produces many harmonic components. The non-linear elements of the rectifying circuitry, such as the diodes, produce harmonics. The application of input signals of different frequencies to a non-linear device such as a diode results in the production of mixing product frequencies that are the sums or differences of the input frequencies. The large-amplitude harmonic components that are present in any rectifier greatly increases the number and amplitude of mixing products. Not only do these diodes receive the power beam frequency, but also cellular telephone transmissions and other such transmission that could generate more harmonics in the rectifying circuit. This could cause further complex harmonics. The present invention defines structure which captures RF-beamed power and more efficiently and effectively traps the harmonic components to keep their reflection and radiation to a minimum. This is done according to the present invention by using a ground plane between the circuit and the source of microwaves; that ground plane shields against RF reflection.

The inventors of the present invention noted a number of problems with this kind of system. A first problem is heat generation. The conversion of microwave into dc causes heat to be generated. All of the components must be sized for this heat production amount. One objective of the present invention is to improve dispersal of heat, leading to lower component temperatures for any given amount of power. This is carried out according to the present invention by using an aperture-coupled patch, where two "orthogonal" polarizations of the microwave energy are coupled through different apertures to different microwave receiving elements. These "orthogonal" polarizations are any two polarizations or polarization parts that have components which are orthogonal to one another. The two elements are located in different locations on the patch. This helps to spread the thermal sources, hence reducing the thermal problem. In addition, the components are directly connected to a thermally-spreading ground plane through via holes, which even further helps to spread the thermal problem.

The inventors recognized that splitting power into two circuits not only spreads the heat problem, but also allows the use of smaller size diodes. These small size diodes can have higher impedances, and are easier to match if high power levels are desired.

The diodes introduce harmonic content to the incident microwave energy, which includes many transients and harmonics. As described above, the harmonics are multiples of the frequency of the beamed RF energy, and sums and differences of these input frequencies. The microwave beam may also be switched on and off. Additional harmonics are caused by resulting transients in the rectifying circuitry caused by any on and off switching. For ultimate efficiency we would want to trap all of the energy in these generated harmonics. This is done according to the present invention by separating the dc conversion structure from the radiating ground station by an electrically-conducting sheet, preferably a copper sheet, which forms a ground plane. This sheet prevents radiating back to the ground station.

The disclosed embodiment describes a rectenna of the aperture coupled patch type. This is often used in a power beaming system such as shown in U.S. Pat. No. 5,068,669, the disclosure of which is herein incorporated by reference. It is known to use an array of rectenna systems for receiving beaming energy. A rectenna of this type is often physically coupled to a patch antenna.

The present invention uses the patch and slot in a different way to capture the energy using techniques which are not taught or suggested by the prior art. According to the present invention, the patch acts as a collector for microwaves. The slots work in conjunction with the patch. A typical slot antenna radiates energy in both hemispheres above the slot and below the antenna of the slot. By placing the patch on one side of the slot, energy is concentrated into the hemisphere which has the patch. The slot antenna and patch together are called an aperture-coupled patch antenna and these are known in the art.

Such known patch antennas have a single slot and a single circuit associated with each patch. Moreover, all of the circuitry is usually on the same side as the patch element.

Rectenna systems prior to the present invention have also required a physical electrical connection between the patch or slot and the circuitry, and circuitry on the same side as the antenna. Many systems use a dc connection between the patch and the circuitry, and others use a so-called probe-fed patch. One problem with the probe-fed patch is that it is connected through other layers to the circuitry. Various stresses may cause the probe to separate from the rest of the patch. Such separation of the probe may constitute a failure mechanism.

BRIEF DESCRIPTION OF THE DRAWING

All of these aspects and others will be described with reference to the accompanying drawings, wherein:

FIG. 5 shows a power beaming system according to the present invention.

DESCRIPTION OF THE PREFERRED EMBODIMENT

A presently preferred embodiment of the rectenna and circuitry and systems which form the rectenna are set forth herein with reference to the accompanying drawings. The rectenna conceptually includes two associated portions: the antenna portion which receives the microwave energy, and a rectifying circuitry portion which converts the microwave energy into the dc power. This system is of the aperture-coupled patch antenna type. Usual systems of this type require a physical connection between the patch element and the rectifying circuitry. Importantly, the present invention preferably uses no direct dc connection between the rectifying circuitry and the antenna element.

The system of the present invention obtains about a half watt per polarization or approximately one watt per patch.

Figure 1:
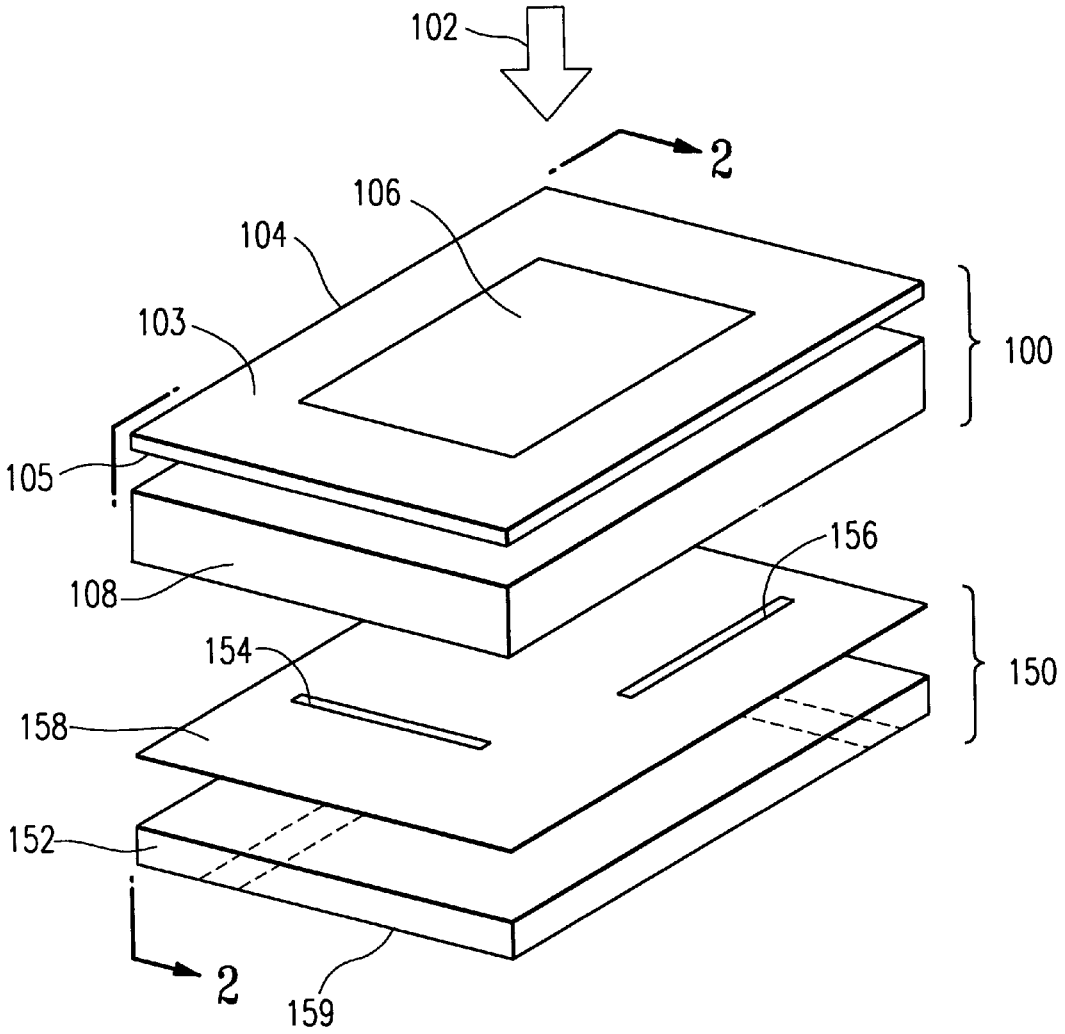
FIG. 1 shows an exploded diagram of the layers forming the patch antenna of the present invention.
Figure 2:
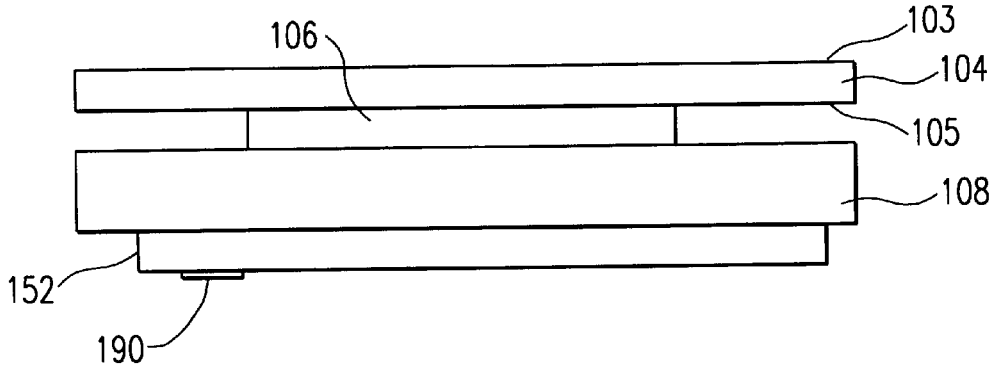
FIG. 2 shows a cross section across the hypothetical line 2—2 in FIG. 1.

FIG. 1 shows a diagram of the layers forming the patch-based rectenna of the present invention. FIG. 2 shows a cross-section across the line 2—2 in FIG. 1.

The rectenna is formed of an antenna portion 100, and a circuitry portion 150. The antenna portion 100 is formed of a number of attached layers of different materials. The layers forming the present invention are preferably held together with a strong adhesive. The preferred adhesive used is a silicon adhesive such as Dow-Corning 314ORTV. Epoxy or any other circuit board adhesive can also be used.

A top protective support layer 104 has surface 103 which faces the direction of the incoming microwave radiation 102. For example, as shown in FIG. 5, microwave radiation 102 is transmitted by one or more antennas 502 to a rectenna array 506 located in an aircraft 504. Support layer 104 is formed of a 50 $\mu$m thick polyimide film, preferably of "Novoclad", available from Sheldahl of Northfield, Minn. Novoclad uses polyimide chains linked together to form a material whose coefficient of expansion is very similar to that of copper. In this way, any heating of the copper and the polyimide do not degrade the integrity of physical connection between the copper and the polyimide.

The copper patch element 106 is laminated to the bottom surface 105 of the polyimide protective film 104. The copper patch element affects the microwave energy characteristics of the coupling slots as known in the art. Patch element 106 acts as part of an antenna layer.

The patch 106 is underlied by a 1 mm dielectric layer 108 which is preferably formed of Rohacell 31. More generally, any kind of foam layer could be used. Rohacell is an aircraft foam with a low dielectric of approximately $\in_R$=1.05. The foam material is lightweight, and reduces the condition in which surface waves may exist. As the dielectric constant approaches 1.0, these surface waves are eliminated. This prevents any surface waves from being excited and adding to loss and thermal heating in the system. Without such a low dielectric material, it is possible that surface waves would be formed in the material. These excited surface waves could cause power to be trapped or dissipated as heat in the materials. These surface wave interactions might also interfere with one another at certain locations. The dielectric absorption layer 108 prevents the surface waves from forming to avoid their trapping any of the power therein.

The energy is received by slots 154 and 156, which, in combination with patch 106, couple the energy to rectifying circuitry 150. Rectifying circuitry 150 converts the energy into dc energy suitable for payload use. This conversion takes place on the opposite side of coupling layer 152 relative to the RF source. Coupling layer 152 is a dual sided copper-coated element, preferably formed of Duroid 5880, approximately 0.5 mm thick and having a dielectric constant $\in_R \approx 2.2$. One side of the copper element includes a ground plane with two orthogonally-directed apertures, preferably formed by coupling slots 154 and 156 therein, each slot having a length along an axial direction. FIG. 1 shows these two coupling slots with their axial lengths facing along perpendicular directions. More generally, however, their lengths need only face along different directions to one another. Any RF energy receiving elements suitable for this use could alternatively be used for this purpose. The slots 154 and 156 receive and focus energy from two opposite polarization components, as described herein.

The other side 170 of the copper sheet, opposite from the ground plane side 158, includes a circuit board with the electronic circuitry used for rectifying formed thereon. This electronic circuitry includes microstrip rectifying circuitry including filters, such as the butterfly stubs shown, and impedance matching circuitry and diodes. This circuitry, which impedance matches and converts to dc, will be further described herein.

One problem that the inventors noted with such patches is that diodes are non-linear elements. Because of this, diodes produce many harmonic frequencies. The layout of the present invention whereby the circuitry is located behind the ground plane relative to the radiation source, minimizes re-radiation towards the source. The only re-radiation which would occur would be that which could pass through the slots in the ground plane. That would be a difficult re-radiation especially since the patch/slot would not be properly matched.

Figure 3:
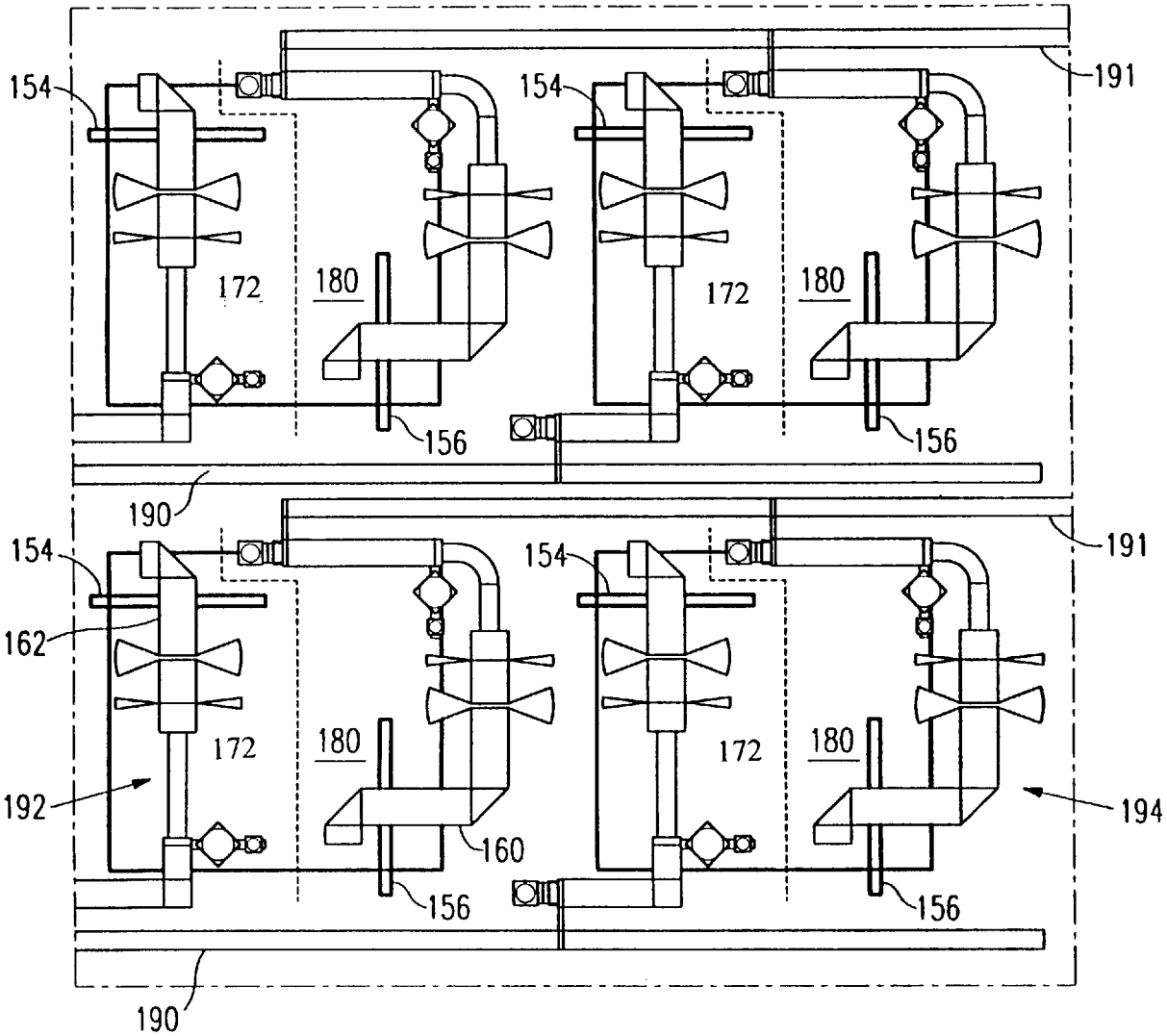
FIG. 3 shows a layout diagram, showing the circuitry used for rectifying, the position of the patches, and the position of the aperture.

FIG. 3 shows a layout of the microstrip rectifying circuitry structure, including the physical relationship between the circuitry, patch 106 and slots 154, 156. Slot 156 overlies a first diode rectifying circuit 160. Slot 154 overlies the other diode rectifying circuit 162. By overlies, we mean that a hypothetical plane, perpendicular to the plane of the layers and hence parallel to the direction of incident microwave radiation 102 in this embodiment, would pass through both the slot and the circuit portions. The present invention operates using slots which preferably receive information from different energy polarization components. In this way, some portion of the power, preferably half, is passed to one part of the circuitry, while the other portion of the power is passed to the other part of the circuitry.

The slots 154, 156 bisect the ground plane and circuitry into two separate sections referred to herein as a first polarization section 172 and a second polarization section 180. Preferably each section handles half the power, so that the heat is more evenly spread over the geometrical area covered by the circuitry. A first circuit is on a first half of the section of the circuitry associated with the patch 106. A second circuit is on a second half of the same section, associated with the same patch. The first half and said second half do not overlap, and hence half the heat is coupled to each of the locations. In addition, since half the power is coupled to each of the locations, each location needs to have components which are only capable of handling that half of the power. This allows smaller diodes, which can have higher impedances and are more easily matched.

The system shown in the present invention allows polarizations to be projected on the two slots. These slots are capable of receiving either right hand or left hand circular polarizations in which case the energy would be split equally between the slots. In addition, the slots are capable of receiving both left hand and right hand elliptical polarizations, however the energy would not be equally distributed between the slots. Two orthogonal linear polarizations can be received, in which case the energy would be split equally between the slots. Note that circular polarization includes vector components of two orthogonal polarizations. Therefore, circular polarization can be used according to this embodiment. If so used, the orthogonal vector components which can be projected onto different vector polarizations will be to split between the different slots.

Furthermore, the pairs of slots are capable of receiving a single linear polarization whose angle is arbitrary. Energy would not be equally distributed between the slots except in the special case where the angle of the linear polarization is 45 degrees with respect to the slot; in which case the energy would be equally distributed between the slots. Both sets of polarizations will operate in a similar way: in both, one slot primarily passes one polarization of the pair and the other primarily passes the other polarization of the pair. This has the effect of allowing roughly half of the power to pass through each slot and hence half of the power to pass to each part of the circuitry. An important aspect of the present invention, therefore, is that there are two separate circuitry elements associated with each patch, each circuitry element receiving roughly half of the power. This has the effect of better spreading the heat.

The rectified power is coupled to bus lines 190, which deliver the dc power to the load. Each of the bus lines 190 is connected to a plurality of the circuit elements. FIG. 3 shows the circuit 192 and 194 both parallel-connected to the bus line 190. The multiple elements hence provide power which is coupled from each of these elements.

Figure 4:
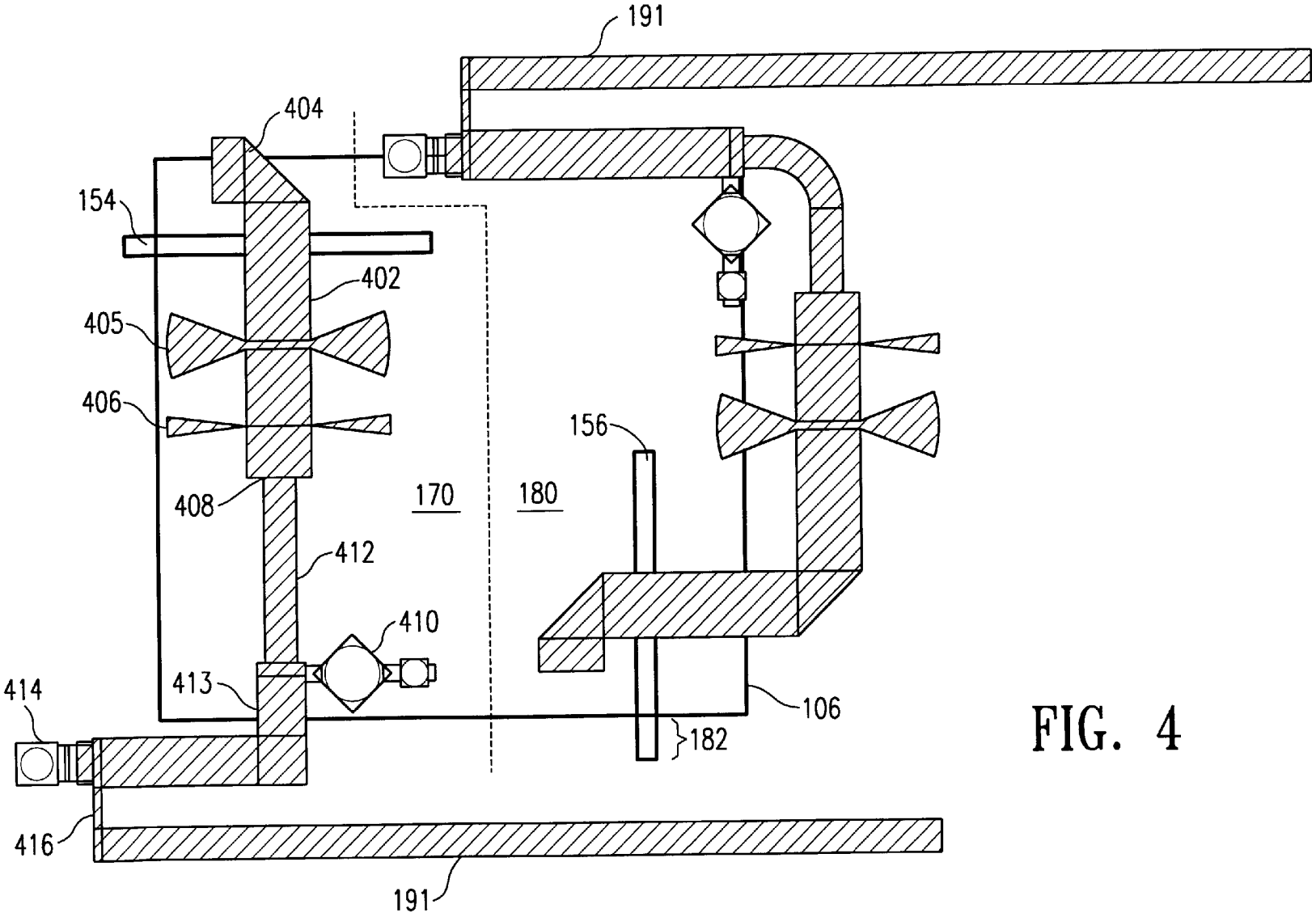
FIG. 4 shows the microstrip circuitry used for rectifying according to the present invention.

A more detailed layout of the rectifying circuitry of the present invention is shown in FIG. 4. It should be understood, of course, that the circuitry carrying out this function could easily be replaced by any other well-known circuitry. This circuitry corresponds to the current way that the inventors have implemented the rectifying circuit of the present invention. Each rectenna element includes the circuitry of FIG. 4, including a first circuit 172, and a second circuit 180, both associated with the same patch 106. Both circuits include the same components, but are located at different locations underlying the ground plane 152. Note that the circuitry is located on surfaces and 158 and 170 of circuitry element 152. A copper ground plane 152 therefore electrically and physically separates the circuitry from the source of microwaves 102. This arrangement further prevents any energy from being reflected back toward the RF source.

The patch used can be of a rectangular or circular/oval/elliptical shape. For a single polarization, the slot is usually located down the center of the patch in an aperture-coupled patch system. It is quite common that the patch completely overlays the entire slot. However, it has been demonstrated in the prior art that one can place the slot and the patch relative to another in such a way that allows at least one of the slots 156, 154 to slightly overhang the edges of the patch. This implementation of the aperture coupled patch is used for this rectenna. This slight overhang can constitute 10 to 20 percent of the length of the slot. This leaves a portion 182 of slot 156 overhanging the area of the patch.

As described herein, the use of two elements of circuitry associates with the single patch better spreads the heat. This ground plane arrangement minimizes the unit cell reflecting any energy back to the original source.

FIG. 4 also shows the relationship between the patch 106, the slots 154 and 156, and the respective circuitry areas 172 and 180. A first polarization of power is coupled through slot 154 to the circuitry 172. The final dc information is coupled onto bus line 190. The other polarization is coupled through slot 156, to circuitry 180, and finally onto bus line 191. Therefore, two separate bus lines carry the dc power received from the two separate polarizations. This allows even better power handling capability in the system.

Many different circuits are known in the art for use on such systems. However the preferred unit cell, associated with one single patch, is described herein.

The energy is coupled through slot 154 to microstrip feeder line 402. Microstrip feeder 402 includes element 404 which terminates the microstrip feeder to change its impedance and thereby obtain a better coupling action. Additional filter and impedance transformation elements 404 and 406 further process the signal to provide further filtering thereon, and to impedance transform for better operation. In this embodiment, the low pass filtering operation filters the system to include signals of frequency less than 8.51 GHz. It should also be understood that while this design of 8.51 GHz was based on the RF sources available at the time, it can easily be adapted to different frequencies. In fact, the desired frequency of operation for this particular design was 8.59 GHz, and this rectenna has sufficient bandwidth to cover the range.

A step area 408 is also provided for additional matching. This additional matching also facilitates impedance matching relative to diode 410. The RF energy passes via microstrip waveguide 412 to diode 410 which rectifies the RF to provide a dc signal near the area 412, and also provides more matching to the capacitor area 414 which provides the additional dc conversion. The final dc-converted signal at 416 is coupled to dc bus 190. The dc bus 190 is connected between the various patches to connect all of the dc from all the patches combined to their final destination.

Although only a few embodiments have been described in detail above, those having ordinary skill in the art will certainly understand that many modifications are possible in the preferred embodiment without departing from the teachings thereof. For example, the layers could be formed of different materials or differently shaped elements. The rectifying circuit is especially susceptible of change, as it should be understood that such rectifying circuits are custom designed for each desired application.

All such modifications are intended to be encompassed within the following claims.

What is claimed is:

1. An energy system, comprising:

an antenna layer arranged to face a source of radio frequency energy, said energy coupled thereto, said antenna layer having a first surface facing the source, and a second surface opposite said first surface and facing away from the source;

an RF shielding layer, located facing said second surface of said antenna layer, such that said antenna layer is between said source and said RF shielding layer, said RF shielding layer including an element therein which allows radio frequency energy to pass therethrough to a second side thereof, said element formed and positioned to receive said radio frequency energy and to minimize any reradiating from said second side of said RF shielding layer back toward the source;

energy rectifying circuitry, including circuitry for rectifying said radio frequency energy into dc energy, at least a part of said energy rectifying circuitry which rectifies said energy being on said second side of said energy shielding layer and separated from said source by said RF shielding layer;

said energy rectifying circuitry including a first element which receives a first part of the radio frequency energy in conjunction with said antenna layer, and a second element which receives a second part of the radio frequency energy in conjunction with said antenna layer, said energy rectifying circuitry comprises at least two circuits disposed in two different areas in a different layer from said first and second elements, said first and second elements spaced from one another, and coupling received RF energy to different ones of said two circuits in the energy rectifying circuitry, wherein each said two circuits include at least one diode, each said diode located on said second side.

2. A system as in claim 1 wherein said element is a rectangular slot.

3. A system as in claim 2 wherein said element includes first and second apertures, each being a rectangular slot having a length along an axial direction, said axial direction of said first aperture facing in a different direction than said axial direction of said second aperture, each said aperture receiving a different portion of energy in conjunction with said patch layer.

4. A system as in claim 1 wherein said first and second elements separate different polarization components of the radio frequency energy to said different circuits.

5. A system as in claim 4 further comprising a surface wave reducing layer, coupled between said antenna layer and said RF shielding layer.

6. A system as in claim 5 wherein said RF shielding layer is a conductor-clad ground plane on a first side of a board, wherein said energy rectifying circuitry is on both sides of the same board.

7. The system of claim 6 wherein said energy rectifying circuitry contains diodes directly connected to said conductor-clad ground plane.

8. A system as in claim 5 wherein said surface wave reducing layer is formed of a low-dielectric lightweight material.

9. The system of claim 1 wherein each of said diodes are connected to said ground plane through via holes.

10. The system of claim 1 wherein said diodes are directly connected to said ground plane through via holes.

11. A method of receiving and transducing beamed energy, comprising:

separating a first part of the beamed energy having a first characteristic, from a second part of the beam energy having a second characteristic, according to the said characteristic of the beamed energy;

coupling the first part of the energy to a first circuit portion in a first physical location;

coupling the second part of the energy to a second circuit portion of the energy receiving board in a second physical location, spaced from said first physical location; and dissipating heat from said first part of said energy in said first circuit to a first location on a ground plane, and dissipating heat from said second part of said energy in said second circuit to a second location on the ground plane.

12. A method as in claim 11 wherein said first circuit is on a first half of an energy receiving circuit board portion, and said second circuit is on a second half of the energy receiving board portion, wherein said first half and said second half do not overlap.

13. A method as in claim 11 wherein said first part of the beamed energy is a first polarization component, and said second part of the beamed energy is a second polarization component different than the first polarization component.

14. A method as in claim 11 wherein said coupling is effected without any dc connection.

15. The system as in claim 1 wherein said RF shielding layer also comprises a capacitive cover layer.

16. A method of claim 11 wherein said steps of dissipating heat include dissipating heat from said circuits to said ground plane through diodes.

17. A circuit for coupling and receiving RF energy and converting the received RF energy to rectified dc, comprising:

a first receiving element including a flat conductive surface of a specified outer shape;

a ground plane including first and second ground plane apertures therein, said first aperture arranged and shaped to transmit energy having a first characteristic and said second aperture arranged and shaped in size to pass energy having a second characteristic different than said first characteristic; and a rectifying circuit including a first circuit receiving energy having said first characteristic and having a second circuit receiving energy having said second characteristic the first and second circuits being disposed in different physical locations, each of said first and second circuits including a diode connected to said around plane.

18. A circuit as in claim 17 wherein said characteristic is polarization.

19. A circuit as in claim 18 wherein said first polarization is vertical polarization and said second polarization is vertical polarization and horizontal polarization.

20. A circuit as in claim 18 wherein said first and second polarizations are components of circular polarizations.

21. A circuit as in claim 18 wherein said apertures form slot antennas which cooperate with said first receiving element, and wherein a portion of each said slot antenna is not directly underneath any part of said first receiving element.

22. A circuit as in claim 17 wherein said first receiving element is located between said ground plane and the source of the RF energy, and said rectifying circuit is located on an opposite side of said ground plane relative to said source of RF energy.

23. A circuit as in claim 22 further comprising a light-weight layer of low-dielectric foam, located between said first receiving element and said ground plane.

24. A method of receiving beamed energy, comprising:

receiving beamed RF energy in a slot antenna for aperture coupling which is associated with a patch element, said patch element being located on a first side of said slot antenna;

providing a ground plane around said slot antenna which shields against RF penetration therethrough other than that effected by said slot antenna; and rectifying the RF energy into dc energy using multiple circuits on multiple layers, said rectifying occurring on a second side of said slot antenna and said ground plane using diodes connected to the ground plane, so that any harmonic or other radiation caused by rectifying is shielded from a direction of the beamed RF energy.

25. A method as in claim 24 further comprising providing two slot antennas, each of which receives energy having a different characteristic, and coupling energy from each slot antenna to a different one of said circuits, each of said circuits associated with said one patch element.

26. A method as in claim 25 wherein said characteristic is polarization.

27. The method as in claim 24 wherein said diodes are directly connected to said ground plane through via holes.

28. A method of operating an aperture-coupled patch system comprising:

coupling energy containing information, said energy including first and second different kinds of polarization components, to an aperture-coupled patch in said aperture-coupled patch system;

receiving one of said polarization components in a first antenna associated with said aperture-coupled patch and receiving the other of the polarization components in a second antenna associated with the said aperture-coupled patch; and coupling said information from said first antenna to a first circuit in the patch, and coupling information in the second antenna to a second circuit in the patch, said first and second circuits being spaced from one another in different locations to spread heat between said first and second circuits to said different locations.

29. An aperture-coupled patch antenna system, comprising:

a patch element, having a surface, and outer dimensions defining a predetermined shape;

a ground plane;

a slot antenna, partially underlying said patch element, and partially not underlying said patch element, so that a portion of said slot antenna extends beyond an edge of said patch element;

rectifying circuitry positioned to rectify information from said patch element, said circuitry having no dc connection to either the slot antenna or the patch element, and receiving beamed energy therefrom, the rectifying circuitry including two separate circuits in two different locations, each of said two circuits including a diode connected to said ground plane.

* * * * *